US006929376B2

(12) United States Patent
Harris

(10) Patent No.: US 6,929,376 B2
(45) Date of Patent: Aug. 16, 2005

(54) SYSTEMS, DEVICES AND METHODS FOR LIGHTING

(75) Inventor: William F. Harris, Charlotte, NC (US)

(73) Assignee: W. F. Harris Lighting, Inc., Monroe, NC (US)

( * ) Notice: Subject to any disclaimer, the term of this patent is extended or adjusted under 35 U.S.C. 154(b) by 20 days.

(21) Appl. No.: 10/304,406

(22) Filed: Nov. 26, 2002

(65) Prior Publication Data

US 2004/0100787 A1 May 27, 2004

(51) Int. Cl.[7] ..... F21V 19/04
(52) U.S. Cl. ..... 362/20; 362/276; 362/802
(58) Field of Search ..... 362/20, 276, 362, 362/802, 95, 375; 307/115, 117, 130

(56) References Cited

U.S. PATENT DOCUMENTS 5,043,855 A 8/1991 Yelvington
5,548,494 A 8/1996 Blackman
5,573,328 A 11/1996 Hwang
6,045,232 A * 4/2000 Buckmaster ..... 362/20
6,158,868 A * 12/2000 Chien ..... 362/84

* cited by examiner

*Primary Examiner*—Sandra O'Shea
*Assistant Examiner*—Guiyoung Lee
(74) *Attorney, Agent, or Firm*—Gregory N. Clements; Ralph H. Dougherty

(57) ABSTRACT

Systems, devices and methods for lighting include a lighting fixture having a first electrical system including a first set of electrical components operable by a first power source located remotely from the lighting fixture. A first light-emitting device is mountable to the housing and energizable through the first electrical system during periods of predetermined levels of light. A second electrical system including a second set of electrical components is operable by a second power source located locally with respect to the lighting fixture. A second light-emitting device is mountable to the housing and automatically energized through the second electrical system during predetermined levels of power from the alternating current power source. And, the first set of electrical components are distinct from and independent of the second set of electrical components. Methods of lighting and reducing energy costs through incorporating the lighting device are also disclosed.

19 Claims, 3 Drawing Sheets

SYSTEMS, DEVICES AND METHODS FOR LIGHTING

BACKGROUND AND RELATED ART

The present invention relates generally to lighting systems, and more specifically, to systems, devices and methods for lighting having multiple modes of operation.

Many systems for lighting a space in or around a home, office or industrial building have multi-functional capabilities. For instance, such systems may provide lighting for daytime or operational lighting, night lighting and emergency lighting. These various capabilities may be designed, for example, to maximize the amount of light generated in a space during working hours, while providing sufficient light to provide guidance or avoid safety issues during non-working hours or emergency situations, and also reducing electricity costs during non-working hours. Further, such systems may incorporate a plurality of different lighting devices that in combination achieve the multiple modes of operation. However, such combinations of different lighting fixtures can be costly and may be complicated to implement. In response to these issues, systems have been developed that incorporate one type of lighting device with multi-functional features, thereby providing the versatility, cost savings and overall utility of requiring only a single lighting fixture within the system. These lighting fixtures provide multi-functional features, however, they also have a number of disadvantages. Current multi-functional fixtures may utilize a single lamp that could have many hours of use, which could reduce the reliability of the lamp when it is required for emergency situations. Further, such multi-functional fixtures may have two different lamps, however, each lamp may be connected to a single electrical circuit. Again, due to the multiple use of the circuit, the circuit's reliability in emergency situations may be compromised. Additionally, such fixtures may not have the versatility of being fixed or portable units or the durability to withstand impacts and resist burning. Thus, due to these and other disadvantages of current multi-functional lighting devices, an improved multi-functional lighting device and corresponding systems and methods of lighting are needed.

SUMMARY OF THE DISCLOSURE

The systems, devices and methods for lighting include a lighting fixture having one or more combinations of features such as multiple modes of operation, independent and separate electrical systems, an environmentally-sealed housing and a fire-resistant, impact resistant and lightweight housing. In one embodiment, for example, such a lighting fixture has a first electrical system including a first set of electrical components operable by a first power source located remotely with respect to the lighting fixture. A first light-emitting device is mountable to the housing and energizable through the first electrical system during periods of predetermined levels of light. A second electrical system including a second set of electrical components is operable by a second power source located locally with respect to the lighting fixture. A second light-emitting device is mountable to the housing and automatically energized through the second electrical system during predetermined levels of power from the second power source. Further, energization of the first light-emitting device is exclusive of energization of the second light-emitting device. And, the first set of electrical components are distinct from and independent of the second set of electrical components.

In another embodiment, a lighting fixture for lighting a space comprises a first electrical system energizable by an alternating current electricity and a first light-emitting device energizable through the first electrical system. A detector system is connectable with the first electrical system, where the detector system has a first output associated with detecting a first predetermined level of light and a second output associated with detecting a first predetermined level of alternating current. A second electrical system is energizable by a direct current electricity, and a second light-emitting device is energizable through the second electrical system. The second electrical system is independent from the first electrical system. And, a switch system enables a connection between the first electrical system and an alternating current power source when the detector system generates the first output. Further, the switch system enables a connection between the second electrical system and a direct current power source when the detector system generates the second output.

In yet another embodiment, a lighting fixture for lighting a space comprises a first electrical system having a first set of components for lighting a light-emitting device via an alternating current power source. The lighting fixture includes a first light-emitting device that is energizable by the first electrical system. A detector system is connectable with the first electrical system. The detector system has a first output and a second output, where the first output is associated with detecting a first predetermined level of light and the second output is associated with detecting a first predetermined level of alternating current. The lighting device also includes a second electrical system having a second set of components for lighting a light-emitting device via a direct current power source, where the second electrical system and second set of components respectively are independent from the first electrical system and first set of components. The lighting fixture includes a second light-emitting device energizable by the second electrical system. A switch system is connectable with the first electrical system and the second electrical system. The switch system enables energization of the first light-emitting device when the detector system generates the first output, and the switch system enables energization of the second light-emitting device when the detector system generates the second output. Further, the switch system enables energization of only one of the first light-emitting device and the second light-emitting device at any given time.

In a further embodiment, a method of lighting a space comprises energizing, through a first electrical system associated with an externally-located first power supply, a first light-emitting device of a lighting system when a measured level of light in the space is within a first predetermined range of levels of light. The method also includes energizing, through a second electrical system associated with an internally-located second power supply, a second light-emitting device of the lighting system during an interruption of the supply of power from the first power supply to the first light-emitting device. The second light-emitting device is independent of the first light-emitting device, and the second electrical system is independent of the first electrical system.

In another embodiment, a method of reducing costs associated with lighting a space comprises energizing a first lighting system having a first level of power consumption during a first set of operating conditions corresponding to a standard lighting mode, where the first lighting system comprises at least one light source connectable with a remote first power supply. The method also includes energizing at least one first light-emitting device associated with at least one second lighting system during a second set of operating conditions corresponding to a reduced light level lighting mode, where the second lighting system is associated with the first power supply, where the reduced light level lighting mode has a second level of power consumption substantially less than the first level of power consumption. Also, the method includes energizing, through a second electrical system associated with a second power supply independent of the first power supply, at least one second light-emitting device associated with the second lighting system during a third set of operating conditions corresponding to a power outage mode. In this method, the second electrical system is independent of the first electrical system.

DETAILED DESCRIPTION OF EXEMPLARY EMBODIMENTS

Embodiments of the present invention comprise systems, devices and methods for lighting. The lighting systems and lighting devices include a multi-functional lighting fixture having at least two independent modes of operation. For example, in a first mode, a first lighting system is energizable by a remote power source during periods of darkness or absence of light. In a second mode, an independent second lighting system is energizable by a local power source when the remote power source is off. These two separate lighting systems are advantageously combined into a single lighting unit that may seal the two lighting systems from the environment and that may be fixedly or releasably mounted. Further, the methods for lighting reduce electricity costs associated with lighting a space through utilization of the multi-functional lighting fixture.

Figure 1:
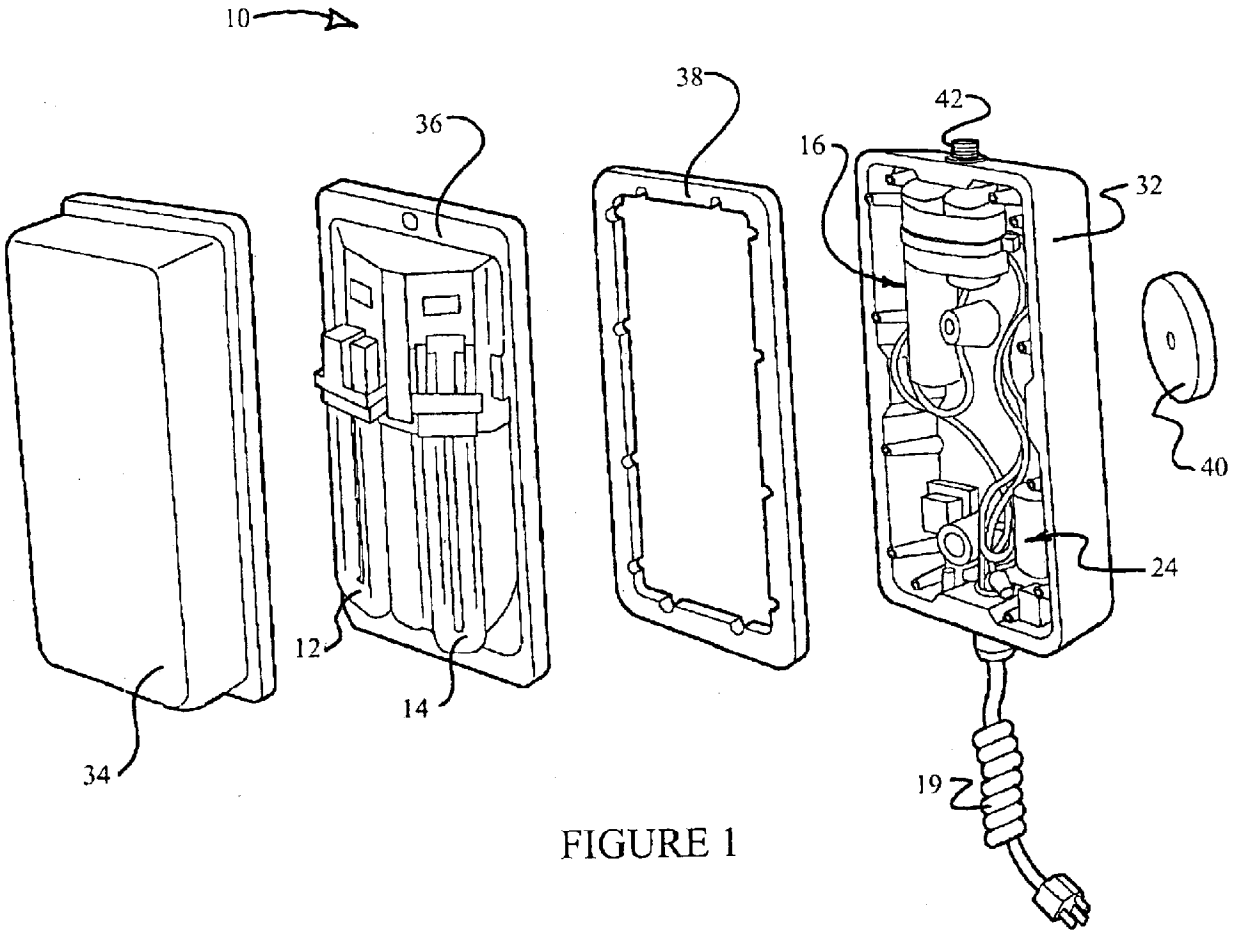
FIG. 1 is an exploded perspective view of one embodiment of a lighting device of the present invention.
Figure 2:
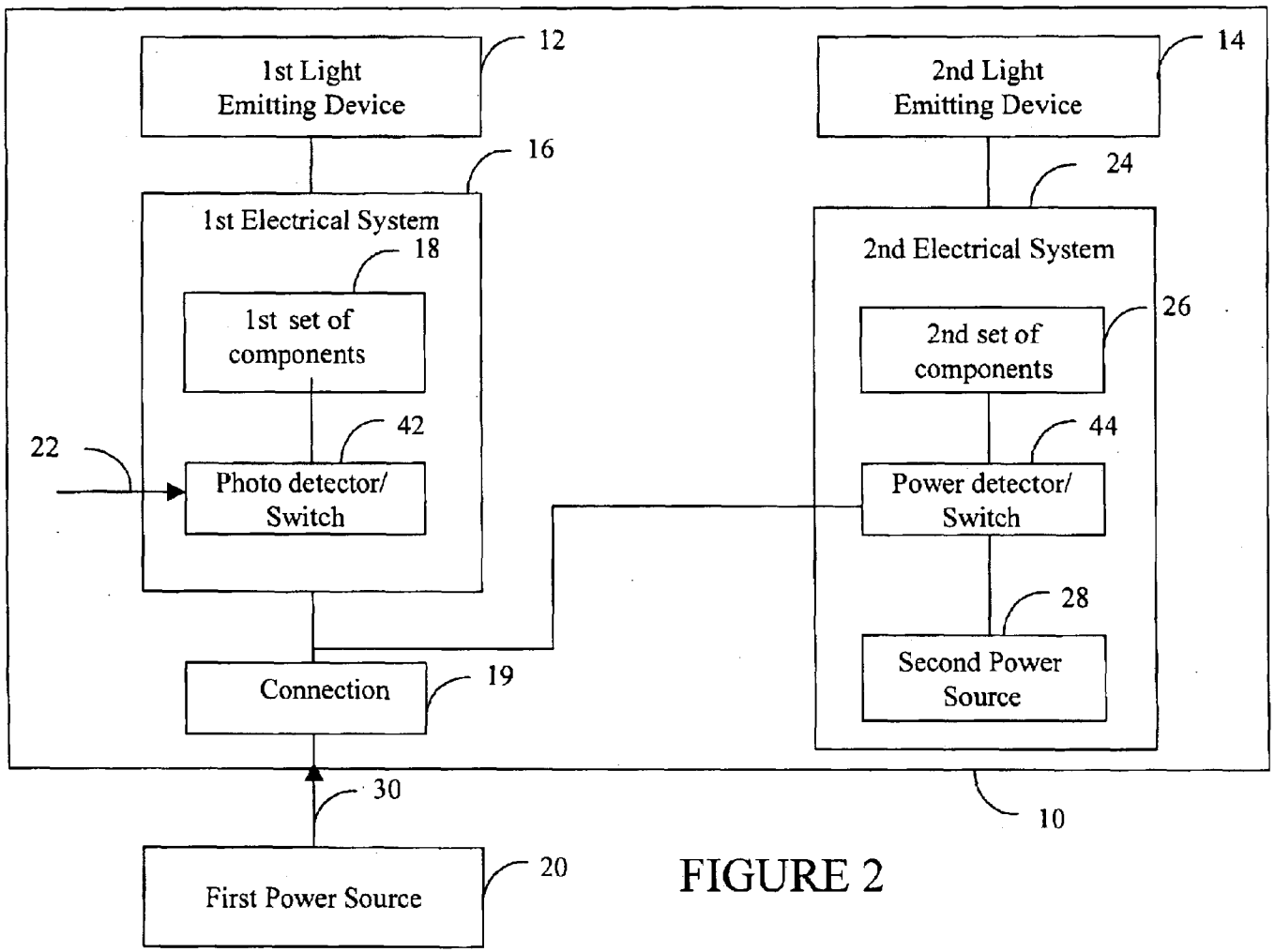
FIG. 2 is a schematic view of portions of the lighting device of FIG. 1.

Referring to FIGS. 1 and 2, one embodiment of a lighting system or device includes a lighting fixture 10 having a first light-emitting device 12 independently operable with respect to a second light-emitting device 14. First light-emitting device 12 is associated with a first electrical system 16 having a first set of electrical components 18 operable through a connection 19 with a first power source 20 (FIG. 2) that may be located remotely with respect to the lighting fixture. In a first mode of lighting device 10, first light-emitting device 12 is energizable through first electrical system 16 during periods of darkness, or during receipt of a level of external light 22 (FIG. 2) within predetermined levels of light. Second light-emitting device 14 is associated with a second electrical system 24 having a second set of electrical components 26 operable by a second power source 28 that may be located locally with respect to lighting fixture 10. In a second mode of lighting device 10, second light-emitting device 14 may be energized through second electrical system 24 when first power source 20 is off, or when the lighting device 10 receives reduced, predetermined levels of power 30 (FIG. 2) from first power source 20. Typically, the energization of first light-emitting device 12 will be independent of the energization of second light-emitting device 14, such as when the first lighting-emitting device is utilized as a night-light and the second light-emitting device is utilized as an emergency light during power outages. In order to improve the usable lifetime and reliable operation of each light-emitting device 12, 14 and each set of electrical components 18, 26, first electrical system 16 and second electrical system 24 are completely separate and independent systems. Thus, a failure in one electrical system 16 or 24 does not affect the performance or reliability of the other, independent electrical system.

First electrical system 16 includes a photo control system that provides lighting through first light-emitting device 12. First electrical system 16 may be activated by darkness, or an absence of light. For example, when a main lighting system or overhead lighting is turned off or when nighttime occurs, first electrical system 16 activates first light-emitting device 12 to provide, for example, egress or security lighting. First electrical system 16 has a photo-detector/switch 42 that detects a level of light 22 external to lighting device 10. Such external light, for example, may be the ambient light present in a space and may include light from other light-generating devices. Upon detecting a level of external light 22 that falls within a predetermined level of light, for example, such as would be associated with nighttime or substantial darkness, photo-detector/switch 42 enables a connection between external first power source 20 and first electrical system 16 to turn on first light-emitting device 12. Further, first electrical system 16 is associated with first power source 20, which may include a direct current power source, an alternating current power source or any other type of power source capable of energizing first light-emitting device 12. Additionally, first electrical system 16 and first electrical components 18 include circuitry and devices, such as a ballast, resistors, inductors, capacitors, circuit boards, etc., to enable a required amount of power from first power source 20 to operate first light-emitting device 12. Thus, first light-emitting device 12 acts as a night-light to improve the lighting in a previously dark space.

Second electrical system 18 includes an emergency or back-up system that automatically turns on second light-emitting device 14 through second power source 28, such as a locally mounted, rechargeable, internal battery pack, to provide light during a power failure. Second electrical system 18 may include, for example, an power detector/switch 44 associated with first power source 20 for activating second electrical system 18 during an absence of power, or reduced levels of power, to first electrical system 16. For example, detector/switch 44 may detect a level of power 30 to first electrical system 16 and connect second electrical system 18 to second power source 28 when the detected level of power 30 falls within a predetermined level. For example, the predetermined level of power may be a level of power received by lighting device 10 less than what is required for operation of first light-emitting device 12, or may be a zero level of power such as when no power is being received. When the detected level of power 30 is outside of the reduced, predetermined levels of power, such as during normal power-available time periods, detector/switch 44 may direct the alternating current power to second power source 28 for charging of the second power source. Further, second power source 28 may additionally include any type of power generation system that is capable of operating second light-emitting device independently from first power source 20. Suitable examples of second power source 28 include a battery, a generator system, an environmentally-powered system, etc. Additionally, second electrical system 24 and second electrical components 26 may include circuitry and devices, such as a ballast, resistors, inductors, capacitors, etc., to enable a required amount of power from second power source 28 to reach second light-emitting device 14.

First and second light-emitting devices 12, 14 may include any type of device that produces light. Suitable examples of first and second light-emitting devices 12, 14 include fluorescent lamps, incandescent lamps, neon lamps, light-emitting diodes and high intensity discharge ("HID") lamps. First and second light-emitting devices 12, 14 may have an energy consumption less than that of adjacently located, externally powered lighting systems to provide lighting device 10 with a power savings advantage over these other systems. Alternatively, first and second light-emitting devices 12, 14 may provide any level of lighting, consume any level of power, and operate with any level of direct or alternating current at any frequency.

Connection 19 may be any mechanism for transferring power from first power source 20 to lighting fixture 10. Suitable examples of connection 19 include a grounded electrical cord, a non-grounded electrical cord, an inductor mechanism, etc.

Lighting fixture 10 may further include a housing 32 onto which first and second light-emitting devices 12, 14 and associated first and second electrical systems 18, 24 may be permanently or removably mounted. Housing 32 may be formed from metals, plastics, composites, glass or any suitable material to which light-emitting devices 12, 14 and electrical systems 18, 24 may be securely affixed. In some embodiments, it may be desirable for housing 32 to be constructed of a material, such as a polycarbonate, that is non-electrically conductive and/or corrosion resistant and/or fire resistant, and/or that has a relatively high impact strength.

Additionally, lighting fixture 10 may include a lens 34 positionable over first light-emitting device 12 and/or second light-emitting device 14 for controlling the light produced by the light-emitting devices. Lens 34 may be permanently or removably mounted to housing 32. Lens 34 may have any level of transparency to the wavelength of light produced light-emitting devices 12, 14 depending on the given application. Lens 34 may be formed from plastics, composites, glass, or any suitable material for achieving a desired level of light emission from lighting device 10. In some embodiments, it may be desirable for lens 34 to be constructed of a material, such as a polycarbonate, that is non-electrically conductive and/or corrosion resistant and/or fire resistant. Further, lens 34 may have a smooth exterior surface for ease of cleaning, while having a clear prismatic interior for optimal lumen output from light-emitting devices 12, 14. Additionally, lens 34 may have rounded corners for increased impact strength and safety.

Further, lighting fixture 10 may include a base plate 36 (FIG. 1), positionable between lens 34 and housing 32, onto which first and second light-emitting devices 12, 14 may be mounted in a spaced apart relationship with respect to first and second electrical systems 18, 24. Base plate 36 may additionally have light-reflecting characteristics, for example on the light-emitting device-facing surfaces, so as to increase the amount of light directed out of lighting fixture 10 from light-emitting devices 12, 14. Base plate 36 may be formed from metals, plastics, composites, glass or any suitable material to which light-emitting devices 12, 14 may be securely affixed. In some embodiments, it may be desirable for base plate 36 to be constructed of a material, such as an aluminum, that is corrosion resistant, and/or fire resistant, and/or that has a relatively high impact strength.

And, in another embodiment, lighting fixture 10 may include one or more seal mechanisms 38 for sealing the entire lighting fixture, and/or first and second light-emitting devices 12, 14, and/or first and second electrical systems 18, 24 from environmental conditions. In one embodiment, for example, seal mechanism 38 is positioned at the interface between lens 34 and housing 32 that encase light-emitting devices 12, 14 and electrical systems 18, 24. Seal mechanism 38 or gasket may include a material such as natural or artificial rubber, foam, plastic and any other water resistant or waterproof material. Alternatively, seal mechanism 38 may include a glue, a cement, a weld or any other mechanism for joining an interface together to resist or completely prohibit passage of external environmental factors, such as water, gases, oils, etc.

Additionally, lighting device 10 may include a mounting mechanism 40 for fixedly or releasably securing the lighting device to a support structure, such as a beam or a wall. Suitable examples of mounting mechanism 40 include a magnetic element, brackets and screws/bolts, a hook, a hook and loop material such as VELCRO® material, straps and clasps, wires, tubing and clamping elements, etc. Mounting mechanism 40 may be positioned on any surface of lighting device 10. For example, lighting device 10 having a fixed mounting mechanism 40 may be utilized as emergency lighting, while lighting device 10 having a releasable mounting mechanism 40, such as a magnet, and a battery operated system, like second electrical system 18, may be utilized as auxiliary lighting.

Lighting device 10 may be utilized individually or in combinations of similar lighting devices. In operation, for example, a method of lighting a space may include energizing, through a first electrical system associated with a first power supply, a first light-emitting device of a lighting system when a measured level of light in the space is within a predetermined range of levels of light. For example, the predetermined range of levels of light may correspond to periods of substantial darkness, where the first light-emitting device acts as a night-light. The measured level of light may be determined by, for example, a photo-detector that also may act as a switch to connect the first electrical system, the first power supply such as an alternating current power source, and the first light-emitting device. The method may further include energizing, through a second electrical system associated with a second power supply, a second light-emitting device of the lighting system during an interruption of the supply of power from the first power supply to the first light-emitting device, where the second light-emitting device is independent of the first light-emitting device, and where the second electrical system is independent of the first electrical system. For example, the interruption of the supply of power from the first power supply to the first light-emitting device may correspond to a power outage, where the second light-emitting device acts as an auxiliary or emergency light powered by a battery. The measured level of power may be determined, for example, by a power detector that also may act as a switch to connect the second electrical system, the second power supply such as a direct current power source, and the second light-emitting device. At times of uninterrupted power from the first power supply, the power detector/switch may allow the power from the first power source to reach the second power source for charging the second power source.

Figure 3:
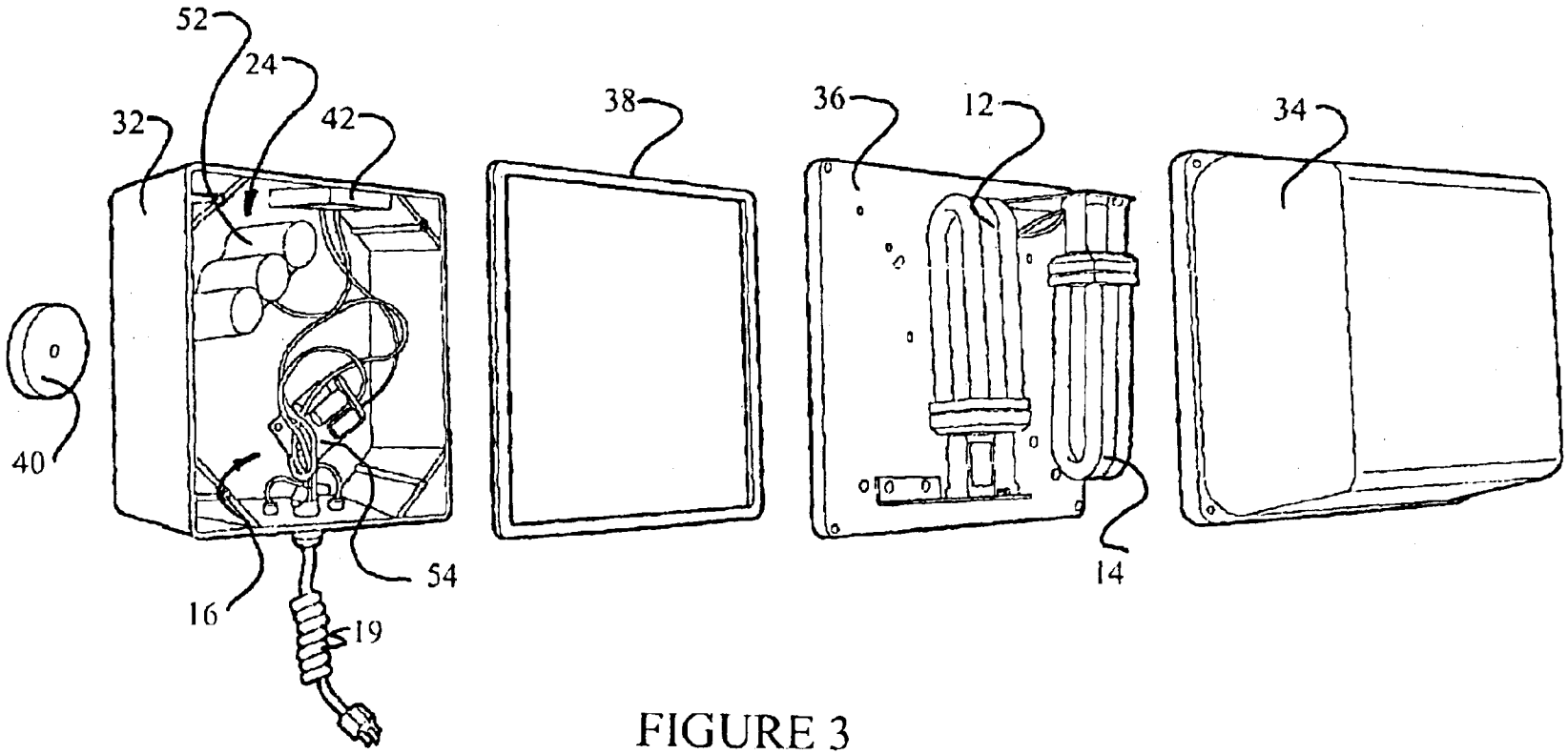
FIG. 3 is an exploded perspective view of another embodiment of a lighting device of the present invention.

Referring to FIG. 3, where like reference numerals indicate like components, another embodiment of a lighting device 50 includes first and second lamps 12, 14 respectively energizable through independent first and second electrical systems 16, 24. Lighting device 50 has at least a dual mode functionality, wherein in a first "night light" mode first lamp 12 is powered through first electrical system 16 after receiving a signal from photo-detector 42 indicating a low level of light. In a second "emergency" or "back-up" mode, second lamp 14 is powered through second electrical system 24, which includes a battery pack 52. Further, both first and second electrical systems 16, 24 may include independent, isolated circuitry mounted on at least one printed circuit boards 54.

Further, lighting devices 10, 50 may form an energy-saving portion of an overall lighting system by providing a lower level of lighting that consumes less power than alternative or standard lighting systems that light a space. It should be noted, however, that in an alternative embodiment lighting device 10 may be utilized to consume greater power and generate more light than alternative or standard lighting systems that light a space. In one energy-saving lighting system, for example, a method of reducing costs associated with lighting a space may include energizing a first lighting system having a first level of power consumption during a first set of operating conditions corresponding to a standard lighting mode, where the first lighting system comprises at least one light source connectable with a remote first power supply. For example, this first lighting system may comprise the normal operating lights of a business or home during normal, full-power operational time periods. The method may further include energizing at least one first light-emitting device associated with a second lighting system during a second set of operating conditions corresponding to a reduced light level lighting mode, such as during darkness or an absence of light. This reduced light level lighting mode is relative to the level of light present during the standard lighting mode. Further, this reduced light level lighting mode has a second level of power consumption substantially less than the first level of power consumption. Also, the second lighting system may include a lighting device, such as lighting device 10, having a discrete, locally-mounted first electrical system associated with the remote first power supply. And, the method may further include energizing, through a second electrical system associated with a second power supply independent of the first power supply, at least one second light-emitting device associated with the second lighting system during a third set of operating conditions corresponding to a power outage mode. The second electrical system may be locally mounted within the second lighting system, and independent of the first electrical system. Further, the second power supply may be a locally mounted battery.

Thus, the above-described systems and methods of lighting provide a first mode of lighting through first light-emitting device 12 and first electrical system 18 that can result in substantial energy cost savings by substituting low level egress/security lighting for high level production illumination during minimal operating periods such as holidays and vacations, during non-production shifts, or other scheduled downtime. A second mode of lighting of the above-described systems and methods of lighting helps to provide safe, battery-powered lighting through areas that otherwise would be unlit during, for example, a power failure. These two modes of lighting, and their associated hardware and circuitry, are independent of one another to provide enhanced reliability and performance.

Although the systems and methods of the present invention have been described with reference to the above-described embodiments and examples thereof, other embodiments and examples may perform the same function and/or achieve similar results. All such equivalent embodiments and examples are within the spirit and scope of the present invention and the following claims are intended to read on such equivalents.

What is claimed is:

1. A lighting fixture, comprising:

a first electrical system comprising a first set of electrical components operable by a first power source located remotely with respect to the lighting fixture;

a first light-emitting device mountable to the housing and energizable through the first electrical system during periods of predetermined levels of light;

a second electrical system comprising a second set of electrical components operable by a second power source located locally with respect to the lighting fixture;

a second light-emitting device mountable to the housing and automatically energized through the second electrical system during predetermined levels of power from the first power source;

a detector system having a first detector and a second detector, wherein the first detector senses a level of light and wherein the second detector senses a level of power from the alternating current power source;

wherein energization of the first light-emitting device is exclusive of energization of the second light-emitting device; and wherein the first set of electrical components are distinct from and independent of the second set of electrical components.

2. The lighting fixture of claim 1, further comprising a switch system having a first switch and a second switch, wherein the first switch connects and disconnects the first electrical system and the first light-emitting device depending on a detected level of light, and wherein the second switch connects and disconnects the second electrical system and the second light-emitting device depending on a detected level of power from the alternating current power source.

3. The lighting fixture of claim 1, further comprising a housing comprised of a metal or a plastic material having fire-resistant characteristics.

4. The lighting fixture of claim 1, further comprising a sealed housing encasing the first light-emitting device, the first electrical system, the second light-emitting device, and the second electrical system.

5. The lighting fixture of claim 1, wherein the predetermined levels of light correspond to a substantially dark state associated with a substantial lack of light, and wherein the predetermined levels of power correspond to a level of power less than a required level of power to operate the first light-emitting device.

6. A lighting fixture for lighting a space, comprising:

a first electrical system energizable by an alternating current electricity;

a first light-emitting device energizable through the first electrical system;

a detector system connectable with the first electrical system, the detector system having a first output and a second output, wherein the first output is associated with detecting a first predetermined level of light and the second output is associated with detecting a first predetermined level of alternating current;

a second electrical system energizable by a direct current electricity;

a second light-emitting device energizable through the second electrical system; and a switch system enabling a connection between the first electrical system and an alternating current power source when the detector system generates the first output, and enabling a connection between the second electrical system and a direct current power source when the detector system generates the second output; and wherein the second electrical system is independent from the first electrical system.

7. The lighting fixture of claim 6, wherein the first predetermined level of light corresponds to a night mode of operation of the lighting fixture.

8. The lighting fixture of claim 6, wherein the first predetermined level of alternating current corresponds to a power outage mode of operation of the lighting fixture.

9. The lighting fixture of claim 6, further comprising a lens.

10. The lighting fixture of claim 6, further comprising a mounting mechanism.

11. The lighting fixture of claim 6, further comprising a seal mechanism.

12. A lighting fixture for lighting a space, comprising:

a first electrical system having a first set of components for lighting a light-emitting device via an alternating current power source;

a first light-emitting device energizable by the first electrical system;

a detector system connectable with the first electrical system, the detector system having a first output and a second output, wherein the first output is associated with detecting a first predetermined level of light and the second output is associated with detecting a first predetermined level of alternating current;

a second electrical system having a second set of components for lighting a light-emitting device via a direct current power source, wherein the second electrical system and second set of components respectively are independent from the first electrical system and first set of components; and a second light-emitting device energizable by the second electrical system;

a switch system connectable with the first electrical system and the second electrical system, wherein the switch system enables energization of the first light-emitting device when the detector system generates the first output, and wherein the switch system enables energization of the second light-emitting device when the detector system generates the second output; and wherein the switch system enables energization of only one of the first light-emitting device and the second light-emitting device at any given time.

13. The lighting fixture of claim 12, further comprising a seal mechanism.

14. The lighting fixture of claim 13, further comprising a lens.

15. The lighting fixture of claim 14, further comprising a mounting mechanism.

16. A method of lighting a space, comprising:

energizing, through a first electrical system associated with an externally-located first power supply, a first light-emitting device of a lighting system when a measured level of light in the space is within a first predetermined range of levels of light; and energizing, through a second electrical system associated with an internally-located second power supply, a second light-emitting device of the lighting system during an interruption of the supply of power from the first power supply to the first light-emitting device, where the second light-emitting device is independent of the first light-emitting device and where the second electrical system is independent of the first electrical system.

17. The method of claim 16, where the first power supply provides an alternating current and where the second power supply provides a direct current, and where the first predetermined range of levels of light corresponds to a substantially dark level of light.

18. A method of reducing costs associated with lighting a space, comprising:

energizing a first lighting system having a first level of power consumption during a first set of operating conditions corresponding to a standard lighting mode, where the first lighting system comprises at least one light source connectable with a remote first power supply;

energizing at least one first light-emitting device associated with at least one second lighting system during a second set of operating conditions corresponding to a reduced light level lighting mode, where the second lighting system is associated with the first power supply, where the reduced light level lighting mode has a second level of power consumption substantially less than the first level of power consumption; and energizing, through a second electrical system associated with a second power supply independent of the first power supply, at least one second light-emitting device associated with the second lighting system during a third set of operating conditions corresponding to a power outage mode, where the second electrical system is independent of the first electrical system.

19. The method of claim 18, charging the second power supply with the first power supply during the first set of operating conditions and the second set of operating conditions, where the first power supply provides alternating current and the second power supply provides direct current.

* * * * *